US009424724B2

(12) United States Patent
Jesme et al.

(10) Patent No.: US 9,424,724 B2
(45) Date of Patent: Aug. 23, 2016

(54) SINGLE TURN MAGNETIC DRIVE LOOP FOR ELECTRONIC ARTICLE SURVEILLANCE

(71) Applicant: BIBLIOTHECA RFID LIBRARY SYSTEMS AG, Rotkreuz (CH)

(72) Inventors: Ronald D. Jesme, Plymouth, MN (US); Dean M. Dowdle, White Bear Lake, MN (US)

(73) Assignee: BIBLIOTHECA RFID LIBRARY SYSTEMS AG, Rotkreuz (CH)

( * ) Notice: Subject to any disclaimer, the term of this patent is extended or adjusted under 35 U.S.C. 154(b) by 442 days.

(21) Appl. No.: 13/958,252

(22) Filed: Aug. 2, 2013

(65) Prior Publication Data

US 2015/0035716 A1 Feb. 5, 2015

(51) Int. Cl.

| | |
|---|---|
| ***H01Q 7/08*** | (2006.01) |
| ***G08B 13/24*** | (2006.01) |
| ***H01Q 7/06*** | (2006.01) |

(52) U.S. Cl.

CPC ..... *G08B 13/2468* (2013.01); *G08B 13/2474* (2013.01); *H01Q 7/06* (2013.01)

(58) Field of Classification Search

CPC ..... H01Q 7/06

USPC ..... 336/212, 217, 218; 340/572, 572.6, 340/572.7; 343/741, 742, 787, 788, 866, 343/867

See application file for complete search history.

(56) References Cited

U.S. PATENT DOCUMENTS

| | | | | |
|---|---|---|---|---|
| 3,195,090 | A * | 7/1965 | Burkhardt | H01F 27/2455 336/211 |
| 4,384,281 | A | 5/1983 | Cooper | |
| 5,008,660 | A | 4/1991 | de Jong | |
| 5,345,222 | A * | 9/1994 | Davies | G08B 13/2474 340/551 |
| 5,440,296 | A | 8/1995 | Nelson | |
| 5,459,451 | A * | 10/1995 | Crossfield | G01V 3/107 340/551 |
| 5,963,173 | A | 10/1999 | Lian | |
| 6,225,905 | B1 | 5/2001 | Tyrén | |
| 6,396,455 | B1 * | 5/2002 | Ely | G08B 13/2411 343/788 |
| 7,973,729 | B2 * | 7/2011 | Bergman | H01Q 1/40 343/742 |
| 2004/0252068 | A1 * | 12/2004 | Hall | H01Q 1/22 343/788 |
| 2011/0136444 | A1 | 6/2011 | Rhodes | |

FOREIGN PATENT DOCUMENTS

| | | |
|---|---|---|
| DE | 198 58 714 | 12/1998 |
| EP | 0 331 269 | 6/1989 |
| GB | 2 101 456 | 9/1981 |

OTHER PUBLICATIONS

International Search Report for PCT Application No. PCT/US2014/048925 mailed on Jan. 27, 2015, 6 pages.

* cited by examiner

*Primary Examiner* — Tho G Phan
(74) *Attorney, Agent, or Firm* — Leason Ellis LLP

(57) ABSTRACT

A single turn loop electronic article surveillance (EAS) gate. The gate includes a closed magnetic core, a multi-turn primary winding wound around the core, and a secondary loop passing through the core once. The secondary loop is a self-supporting single turn loop, and the secondary loop is a transmit loop that generates a magnetic drive field for the article detection gate system.

15 Claims, 7 Drawing Sheets

SINGLE TURN MAGNETIC DRIVE LOOP FOR ELECTRONIC ARTICLE SURVEILLANCE

TECHNICAL FIELD

The present invention relates to electronic article surveillance (EAS) systems, and more specifically, to EAS systems with a self-supporting single turn transmit loop.

BACKGROUND

EAS systems can be used to prevent unauthorized removal of merchandise from stores or retail settings, and prevent removal of books or other lending media from libraries without the item first being checked out. EAS systems typically include a detection system, often made of two side gates between which an individual must pass to exit a store or library. The gates generate an electromagnetic field that is used to excite a response from a security tag attached to the merchandise, book or media. A variety of tags are used in EAS systems and include magnetomechanical (also known as acousto-magnetic), radio frequency identification (RFID) and magnetic (also known as magneto-harmonic) tags.

EAS systems present a variety of challenges, including providing gates that generate sufficient magnetic drive fields to fully cover the area between two gates; designing or placing tags that are not easily shielded from a magnetic drive field generated by the EAS gates; and providing cost-effective EAS gates and tags that are proportional in value to the merchandise or media they are being used to track.

SUMMARY

The present invention provides an elegant solution for an EAS gate where the transmit loop is made of a single turn loop. This construction provides several advantages over existing EAS gates. For example, the single turn loop construction provides a light-weight solution, allowing the gate to be more easily supported. The single turn loop construction allows for manufacturing options that are lower-cost than current EAS gate constructions due to both reduced material and labor costs. A simpler construction can also result in reduced likelihood of gate failure. The present invention also allows for construction of an EAS gate without the need for a molded exterior, providing for a narrower gate with improved aesthetics.

In one embodiment, the present invention provides a single turn loop electronic article surveillance gate. The gate includes a closed magnetic core; a multi-turn primary winding wound around the core; and a secondary loop passing through the core once. The secondary loop is a self-supporting single turn loop, and the secondary loop is a transmit loop that generates a magnetic drive field for the gate.

In another embodiment, the present invention provides an electronic article surveillance system. The electronic article surveillance system includes a gate including a receive coil and a transmit loop. The transmit loop is a rigid loop forming a secondary loop of a transformer. The transformer further includes a closed magnetic core and a primary winding wound around the core. The receive coil is comprised of two symmetrical loops.

BRIEF DESCRIPTION OF DRAWINGS

The invention may be more completely understood in consideration of the following detailed description in connection with the accompanying drawings, in which.

Figure 1:
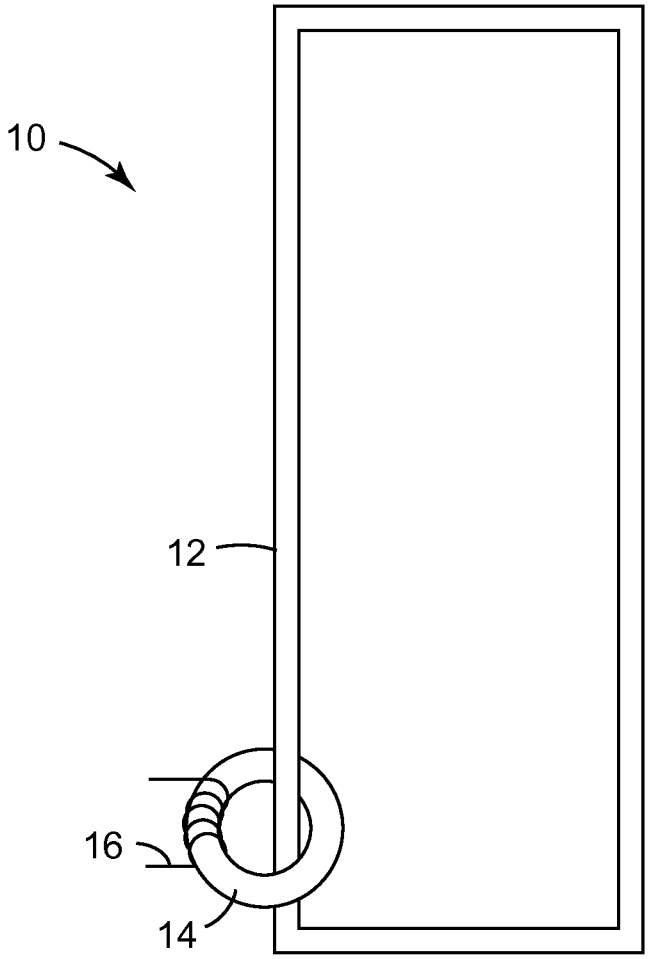
FIG. 1 shows a single loop turn EAS gate.

In the following description of illustrated embodiments, reference is made to the accompanying drawings, in which are shown by way of illustration various embodiments in which the invention may be practiced. It is understood that the embodiments may be utilized and structural changes may be made without departing from the scope of the present invention. The figures are not necessarily to scale. Like numbers used in the figures refer to like components. However, it will be understood that the use of a number to refer to a component in a given figure is not intended to limit the component in another figure labeled with the same number.

DETAILED DESCRIPTION

The following description provides more detailed information about the present invention, including illustrations of various embodiments of the present invention. Magnetic EAS systems are typically formed with pairs of gates. Each gate may include both a winding or loop for transmitting a signal to generate a magnetic field and a second winding or loop to receive or detect signals created by tags responding to the generated magnetic field.

The transmit loop of an EAS gate typically produces a magnetic field of magnitude greater than 50 microTesla (μT) over much of an area large enough to create a portal so that a human can easily walk between a pair of such EAS gates. Such a portal often has a cross section sized in the range of 1 square meter. The magnetic field is generated by driving current through a loop or coil of wire. The magnitude of the magnetic field is directly proportional to the product of the current times the number of coil turns (units of Amp-turns). To produce a 50 μT or greater magnetic field over the desired volume, something like 200 Amp-turns must be generated in the drive winding. Such a magnetic field can be created, for example, by driving 10 Amps through a coil of 20 turns.

Multi-turn transmit coils can have several costs associated with them. For example, such coils typically require some type of mechanical support, which increases manufacturing costs. Multi-turn transmit coils can also generate acoustic noise via the Lorentz force which tends to cause mutual attraction of adjacent turns of a coil when current is driven through the turns of the coil, often resulting in an audible vibration that can be objectionable.

Multi-turn transmit coils can require higher voltages than those required in the current invention. For example, some multi-turn transmit coils may have voltages as high as 100 V on their transmit coils. Such voltage levels may require that the multi-turn loop be electrically insulated to prevent human exposure to high voltages. Such insulation may be in the form of a large molded structure, further increasing manufacturing cost.

In contrast to a transmit coil made with several (or even many) turns, a single turn loop as described in the present disclosure can generate a sufficient magnetic field by driving about 200 Amp-turns in a single turn loop. Such a construction can provide the appropriate Amp-turns with lower voltages, such as voltages in the range of 1 V to 5 V. Such a loop can be self supporting and have several other advantages as discussed throughout the present disclosure.

FIG. 1 shows a diagram of a single turn loop EAS gate 10. Gate 10 includes transmit loop 12, magnetic core 14 and multi-turn winding 16, which together function as a transformer to produce a magnetic field surrounding the gate. Gate 10 functions to drive sufficient Amp-turns (often in the range of about 200 Amp-turns) through transmit loop 12 to generate a magnetic field for detecting security tags attached to items that may be carried between a pair of gates.

The transformer can have a range of configurations. For example, multi-turn winding 16 may have a variety of turns for example, between 50 and 100 turns. The current driven through multi-turn winding may vary inversely with the number of turns in the multi-turn winding 16. For example, in an embodiment with 84 turns of multi-turn winding 16, the current level may be in the range of 2.25 to 2.75 amps. The Amp-turns driven by transmit loop 12 can be calculated by multiplying the current driven through multi-turn winding 16 by the number of turns in multi-turn winding 16. For example, to drive 200 Amp-turns through transmit loop 12, 2.38 amps could be driven through an 84-turn winding. Alternatively, 4 Amps could be driven through a 50-turn winding.

Physically, transmit loop 12, closed magnetic core 14 and multi-turn winding 16 can be constructed from a variety of materials. In one embodiment, transmit loop 12 can be made, for example, in one embodiment, of round, solid copper with a 0.375 inch diameter or copper pipe with an outer diameter of 0.625 inches and a wall thickness of 0.62 inches. While a variety of sizes and configurations can be used for transmit loop 12, a structure with a smaller diameter can often result in lower loss when transmitting a signal and can be more aesthetically pleasing. Transmit loop 12 may also be made from aluminum. Transmit loop 12 may also be made from a mixed composition comprising primarily aluminum or copper. Transmit loop 12 may have a variety of shapes, covering a range of area. In one embodiment, transmit loop 12 encloses an area in the range of 0.8 $m^2$ to 1.0 $m^2$. In some embodiments, transmit loop 12 may be self-supporting such that it holds its vertical structure when mounted at the base.

Figure 2:
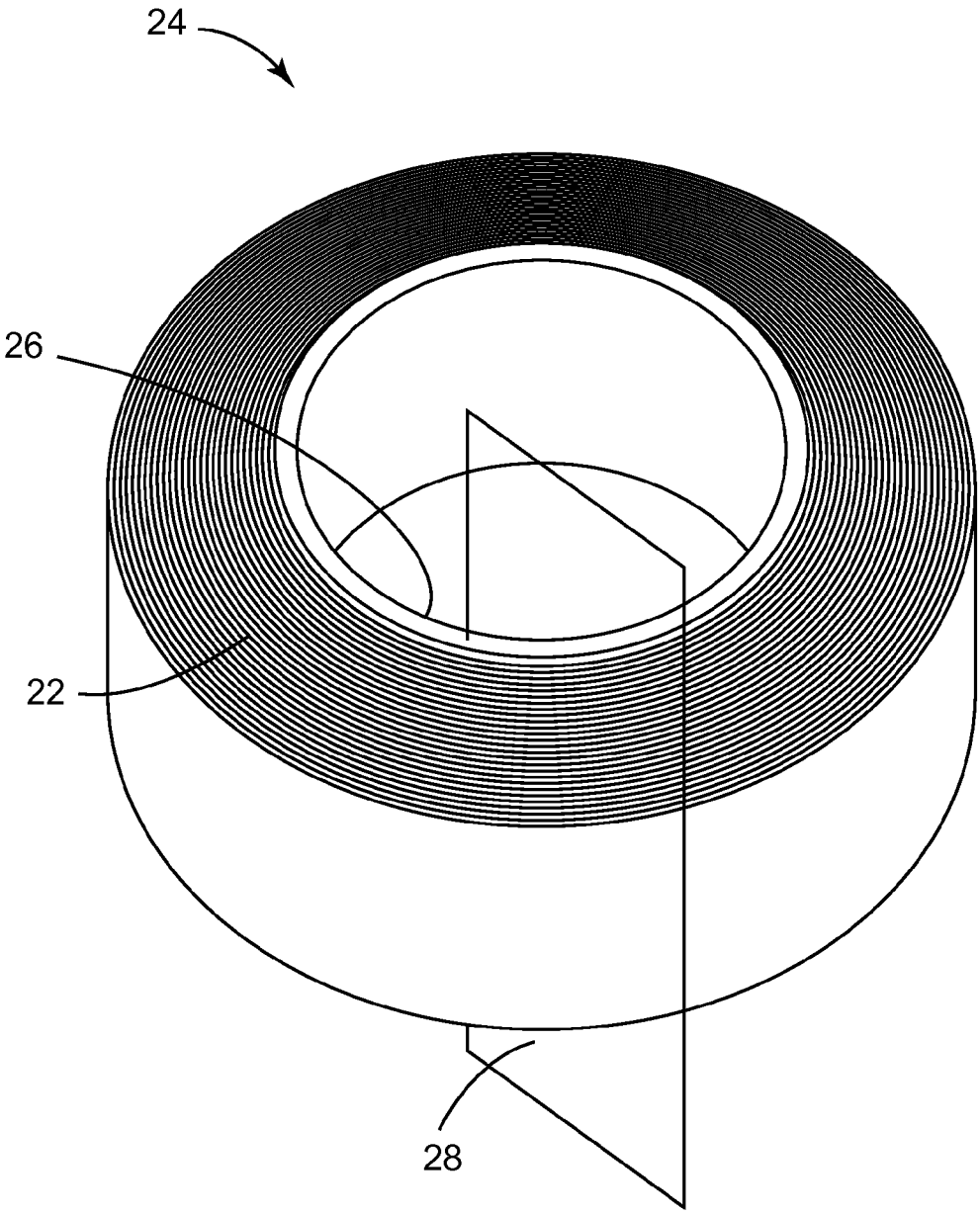
FIG. 2 shows an exemplary closed magnetic core.

Closed magnetic core 14, as discussed in further detail with respect to FIG. 2, may be formed from a molded, wrapped or otherwise fashioned magnetic material, such as silicon iron, ferrite or any other appropriate materials as may be apparent to one of skill in the art. A closed core is one that is continuous or substantially continuous. An example of a closed form is a toroid.

Multi-turn winding 16 is wrapped around closed magnetic core 14 and may be made of any appropriate conductive material, such as stranded copper, aluminum or another type of wire. The wire could additionally be insulated. The number of turns for multi-turn winding 16 may vary based on the specific design.

FIG. 2 shows an exemplary closed magnetic core 24. In this embodiment, magnetic core 24 is formed of a thin magnetic strap 22 wrapped or coiled about a center form 26. In some embodiments, center form 26 may be temporary and used only for forming closed magnetic core 24. Magnetic strap 22 may be made of a variety of materials, for example, silicon iron, ferrite or any other appropriate materials as may be apparent to one of skill in the art.

Magnetic core 24 may also be a variety of shapes. In one embodiment, magnetic core 24 may be cylindrical. Magnetic core 24 may also be toroidal, have a square circumference, or be any other appropriate shape.

The size of magnetic core 24 may vary based on a variety of factors. Saturation of the core can limit how small the magnetic core 24 may be and other factors such as cost and cosmetics can serve as upper size limiting factors for magnetic core 24. In some embodiments, the cross section of magnetic core 24 may be in the range of 500 to 1,500 $mm^2$. Additionally, the diameter of magnetic core 24 should be large enough to allow the turns of winding 16 and loop 12 (FIG. 1) to pass through the center hole of magnetic core 24.

After the multi-turn winding is wrapped about magnetic core 24, the construction, including both magnetic core 24 and multi-turn winding 16 may be potted to prevent mechanical motion generated by current driven through the multi-turn winding 16. Potting often includes filling the voids with a material that hardens. The hardening material is often non-conductive, can prevent moisture or motion and therefore acoustic noise, and can increase durability and improve insulation resistance.

Figure 3:
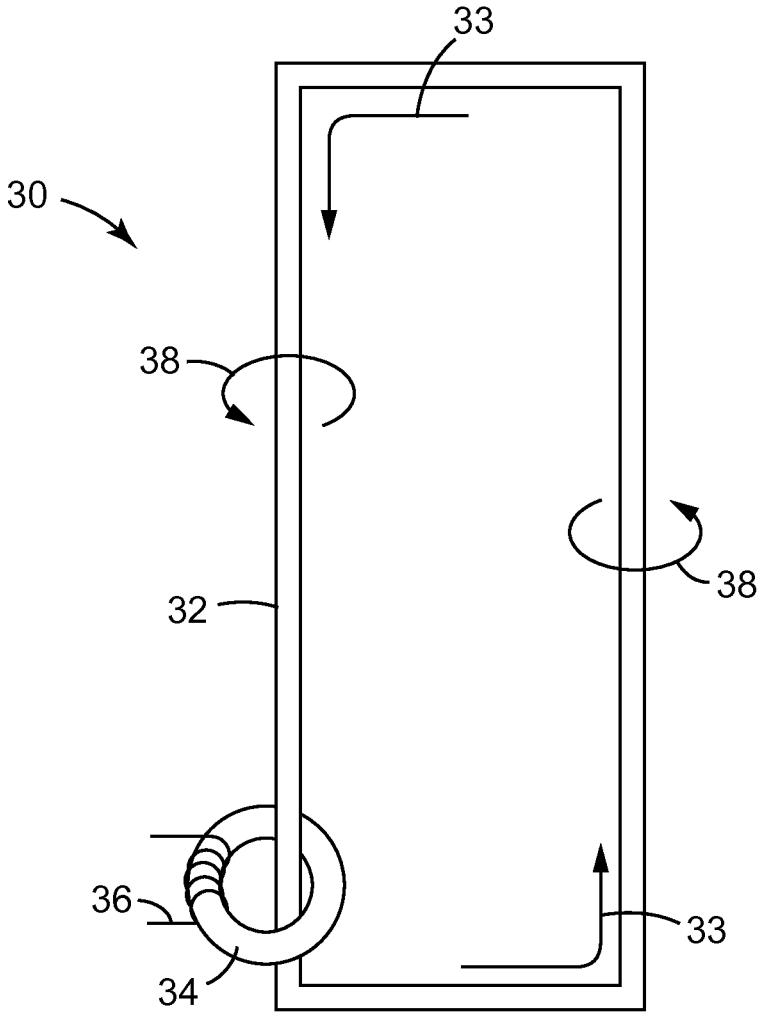
FIG. 3 shows an illustration of the magnetic drive field generated by a transmit loop of an EAS gate.

FIG. 3 shows an illustration of the magnetic field flux 38 generated by a transmit loop 32 of an EAS gate 30. Arrows 33 indicate the direction of current in transmit loop 32. Resulting magnetic field flux 38 follows the Right Hand Rule with respect to transmit loop 32. The magnitude of magnetic drive field is dependent on the number of Amp-turns being driven via transmit loop 32.

The frequency of magnetic drive field can range significantly, but typically is a lower frequency. For example, the frequency of magnetic drive field may be about 400 Hz, about 500 Hz, or in the range of 200 Hz to 1,000 Hz. There are a number of factors to consider in determining the frequency of magnetic drive field. As the frequency of the magnetic drive field increases, the transmit loop 32 experiences greater loss due to increased transmit loop AC resistance. However, a higher frequency magnetic drive field increases the amplitude of the output of the receive coil for a security tag passing through the field.

Figure 4:
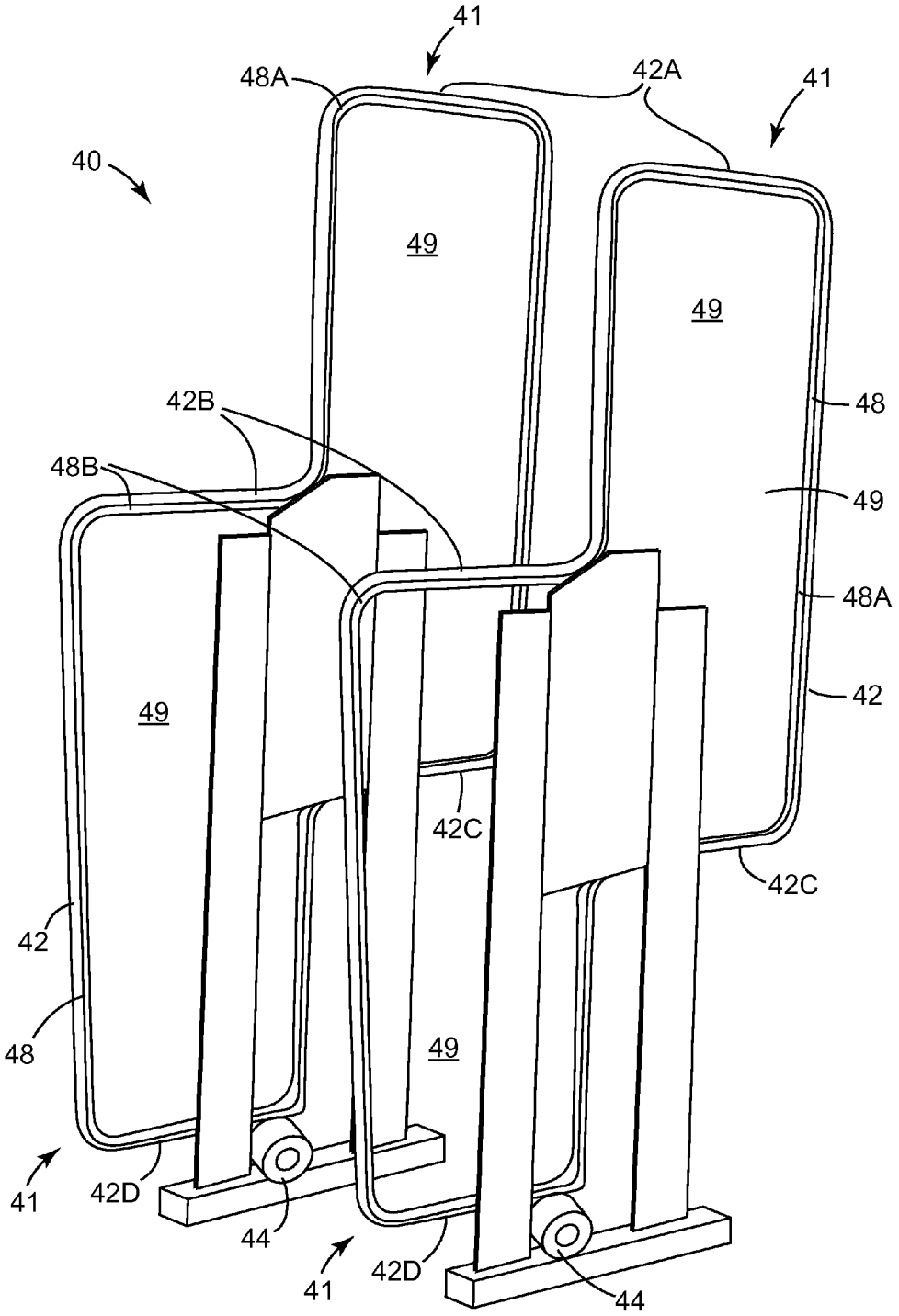
FIG. 4 shows an EAS gate system including a transmit loop and a receive coil.
Figure 5A:
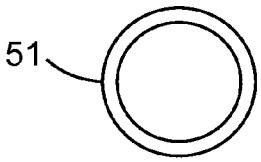
FIGS. 5A-5K show exemplary cross section shapes for a transmit loop.
Figure 5B:
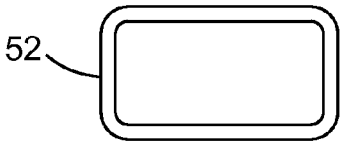
Figure 5C:
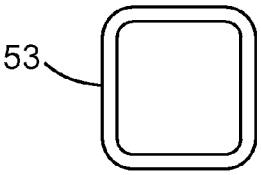
Figure 5D:
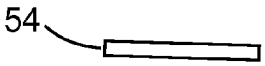
Figure 5E:
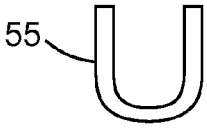
Figure 5F:
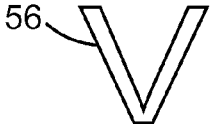
Figure 5G:
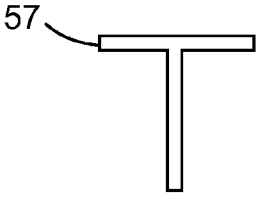
Figure 5H:
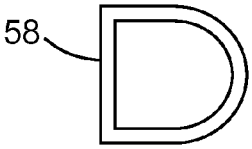
Figure 5I:
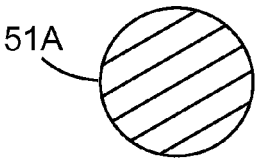
Figure 5J:
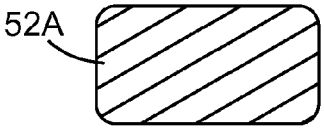
Figure 5K:
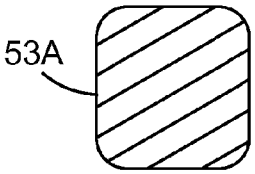

One important challenge in designing an EAS gate is to ensure there are no "dead zones" between a pair of EAS gates 30 such that a tag passing through that zone would not be detected. One way to shift the coverage of the magnetic drive field to change the shape of transmit loop 32. For example, FIG. 4 shows an EAS gate with a varied transmit loop shape to provide improved magnetic field coverage. EAS gate 30 may be configured such that the transmit loop 32 is capable of generating a magnetic drive field extending at least 0.4 meters, 0.5 meters or more from EAS gate 30.

FIG. 4 shows an EAS gate pair 40 including a transmit loop 42 and a receive coil 48. In this configuration, individual EAS gates 41 are spaced about 1 meter from each other. The distance between EAS gates 41 can be determined by accessibility requirements of the respective jurisdiction. Each EAS gate 41 includes a potted magnetic core 44 with a multi-turn winding through which current is driven to transmit loops 42. Transmit loop 42 generates a magnetic drive field, with each magnetic drive field extending approximately half-way between the EAS gate pair 40.

Each EAS gate 41 further includes a receive coil 48. Receive coil 48 may have a variety of configurations. In this configuration, receive coil 48 wound on area filler 49 and is co-planar with transmit loop. Receive coil 48 may be contained in the same housing, lattice or gate as transmit loop 42, and may or may not be co-planar with transmit loop 42.

In one configuration, receive coil 48 can be formed of two symmetrical loops 48A and 48B. The respective loops 48A and 48B are wound oppositely, i.e., one clockwise and the other counterclockwise. One benefit of using two symmetrical loops is that the two loops 48A and 48B cancel out the induced voltage from the drive circuit flux from the transmit loop 42 so that loops 48A and 48B can adequately detect disturbances in the field by tags. Receive coil 48 may enclose a relatively large area. For example, in some embodiments, receive coil 48 or receive coils 48A and 48B cumulatively may enclose 75% or more of the area enclosed by transmit loop 42.

In the configuration illustrated in FIG. 4, transmit loops 42 each include four horizontal segments 42A-42D. Horizontal segments 42A-42D can prove advantageous as they provide variation in the direction of the magnetic drive field generated by transmit loops 42, to allow for more complete field coverage of an area between the EAS gate pair 40.

In some configurations, transmit loop 42 may be made of several pieces of material joined together or may be constructed of a single piece of material joined in one location. Because of the low voltage possible as described in the present disclosure, transmit loop 42 may form the outer structure for EAS gate 41, and the surface of transmit loop 42 may be exposed so that an individual walking through or near EAS gate pair 40 may touch transmit loop 42.

EAS gate pair 40 is configured to work collectively so that the cumulative magnetic drive field emitted by transmit loops 42 covers the majority of the area between EAS gate pair 40. When a soft magnetic material, RF tag, or other tag or security item passes between EAS gate pair 40, the item disturbs the magnetic field, and receive coils A and/or B may then detect the presence of such item or soft magnetic material and trigger an alarm.

While FIG. 4 illustrates one embodiment for an EAS gate pair 40, an EAS gate pair consistent with the present disclosure may take a variety of configurations, with changes in distance between EAS gates 41, configuration of transmit loops 42 and associated receive coils 48, difference in mounting, area filler 49 and other items.

FIGS. 5A-5K show exemplary cross section shapes for a transmit loop. While transmit loop 42 in FIG. 4 is illustrated as a round copper pipe, various shapes for the cross section of the transmit loop will impact the resistance of the transmit loop 42 acting as a conductor. The shape of a cross section of transmit loop 42 also affects the aesthetic appeal of an EAS gate incorporating transmit loop 42.

FIGS. 5A-5K show exemplary cross-sectional shapes for a transmit loop conductor including round cross-section 51, rectangular cross-section 52, square cross-section 53, flat cross-section 54, U-shaped cross-section 55, V-shaped cross-section 56, T-shaped cross-section 57, D-shaped cross-section 58, solid round cross-section 51A, solid rectangular cross-section 52A and solid square cross-section 53A. In these various cross-sectional shapes, corners may be rounded consistent with the cross-sectional shapes. Additionally, some cross-sections are closed, such as round cross-section 51, rectangular cross-section 52, square cross-section 53, and D-shaped cross-section 58. Others are open, such as flat cross-section 54, U-shaped cross-section 55, V-shaped cross-section 56, and T-shaped cross-section 57. Cross sections may be solid or hollow. A transmit loop consistent with the present invention may have either a close or an open cross-section.

Example 1

Cross-Sectional Shape Variation

The AC resistance of a variety of cross-sections that could be used in copper transmit loops consistent with the present disclosure was modeled with respect to changing frequency. The results of such modeling are shown in FIG. 6.

The various types of cross-sections modeled and the corresponding result identifier are shown in Table 1 below.

TABLE 1

Figure 6:
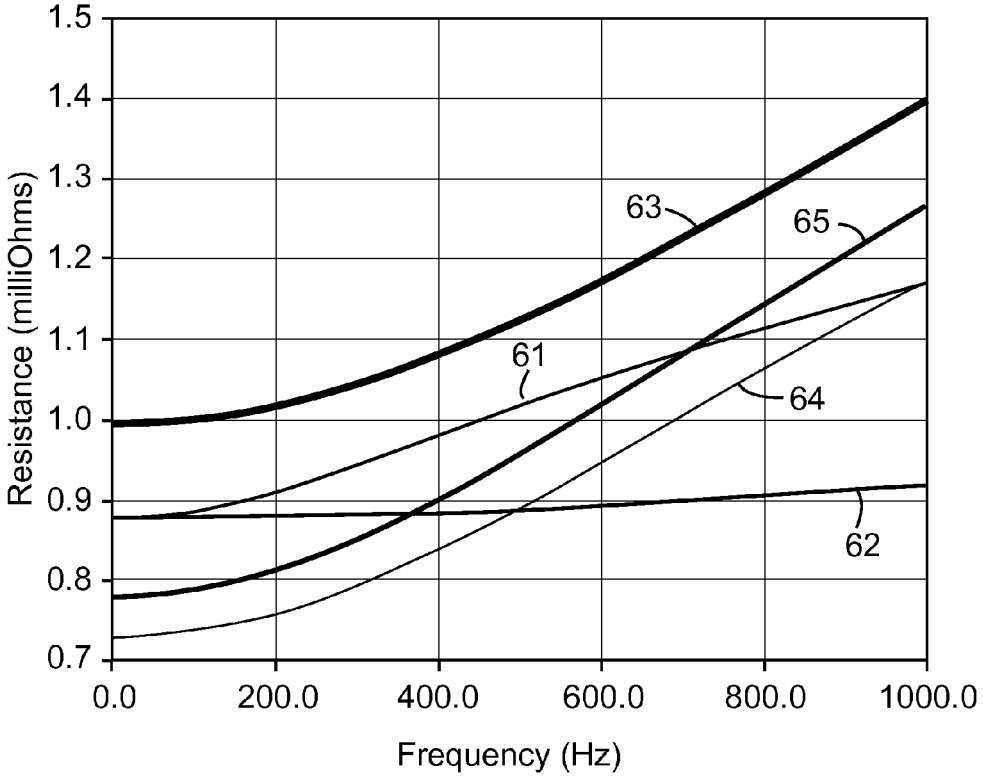
FIG. 6 is a chart illustrating resistance associated with various cross sections for a transmit loop.

Cross Sections Modeled in FIG. 6

| Cross-Section | Shape | Dimensions (in inches) |
|---|---|---|
| 61 | Flat | 0.1250 × 1 |
| 62 | Tubular | 0.072 wall thickness × 0.625 outer diameter |
| 63 | Solid round | 0.375 diameter |
| 64 | Solid round | 0.4375 diameter |
| 65 | Square | 0.375 × 0.375 |

The various types of cross-sections modeled and the identifying number are shown in Table 1 above. Providing modeling of AC resistance allows one to intelligently choose a cross section for a transmit loop based on the other design features.

For example, in a configuration where the transmit loop may be operated at a variety of frequencies, a cross-section with relatively flat AC resistance may be desirable for the purpose of consistent performance. For example, the resistance of cross-section 62 is relatively flat across the shown frequency range and may be a good option for such a design scenario.

In another scenario, for a gate designed to operate at a particular frequency, for example, 400 Hz, it may be desirable to choose a cross section for transmit loop that is the lowest at that particular frequency. Therefore, cross-section 64 would provide a good option for a gate designed to operate at 400 Hz.

Example 2

Exemplary Drive Circuit for Transmit Loop

Figure 7:
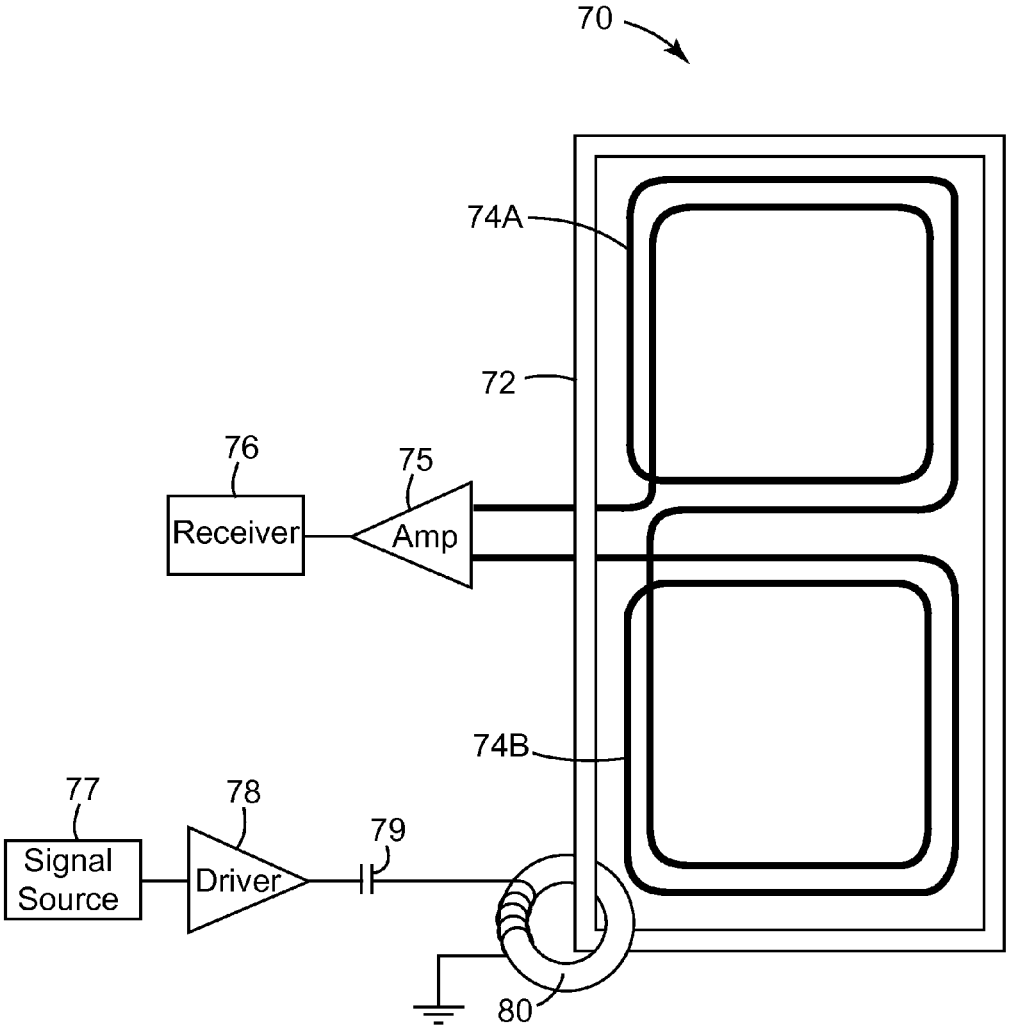
FIG. 7 shows a circuit diagram illustrating a single loop turn EAS gate.

FIG. 7 shows a circuit diagram for an exemplary gate 70. Gate 70 includes transmit loop 72 and receive coils 74A and 74B. Receive coils 74A and 74B are similar receiver sub-coils wound in opposite directions and connected in series. The receive coils 74A and 74B are connected to a differential amplifier 75. The amplified signal from receive coils 74A and 74B is passed to the remainder of the receive circuitry 76 where the received signal is further processed.

A signal source 77 generates a sinusoidal signal which is passed to a driver circuit 78. In this example, the RMS value of the signal generated by signal source 77 is 0.59 V. The driver circuit 78 provides the current and voltage required to generate the desired magnetic field via the single turn loop. In this instance, the drive current and voltage generated by driver circuit 78 is 2.5 Amps and 22.1 V. The inductance presented by the primary of the toroidal transformer is resonated with capacitor 79, with a value of 5.5 μF so that the driver circuit 78 drives a purely resistive load. The toroidal transformer 80 and capacitor 79 provide an impedance match between the driver circuit 78 and the single turn loop 72. The current driven through the single loop turn 200 Amps and the voltage across it is 1.6 V. The magnetic field is generated by single turn loop's 72 200 Amp-turns.

What is claimed is:

1. An electronic article surveillance (EAS) gate comprising:

a closed magnetic core;

a multi-turn primary winding wound around the core; and a secondary loop passing through the core once;

wherein the secondary loop is a self-supporting single turn loop, and wherein the secondary loop is a transmit loop that generates a magnetic drive field for the EAS gate.

2. The gate of claim 1, wherein the magnetic core is a toroidal shape.

3. The gate of claim 1, wherein the magnetic core is constructed of a coiled magnetic strap.

4. The gate of claim 1, further comprising a receive coil, wherein the receive coil is coplanar with the transmit loop.

5. The gate of claim 1, further comprising a receive coil, wherein the receive coil is contained in the same housing, lattice or gate as the transmit loop.

6. The gate of claim 1, wherein the area enclosed by the transmit loop is in the range of 0.8 to 1.0 $m^2$.

7. The gate of claim 1, wherein a cross section of the magnetic core is in the range of 500 to 1,500 $mm^2$.

8. The gate of claim 1, wherein the secondary loop is comprised primarily of copper or aluminum.

9. The gate of claim 1, wherein the frequency of the magnetic field drive field is between 200 Hz and 1 kHz.

10. The gate of claim 1, wherein the transmit loop includes two or more horizontal segments.

11. The gate of claim 1, wherein the transmit loop is constructed of a single piece of material joined in one location.

12. The gate of claim 1, wherein the primary winding is potted to prevent mechanical motion.

13. The gate of claim 1, wherein the surface of the transmit loop is exposed.

14. The gate of claim 1, wherein a cross section of the transmit loop is closed and is at least one of: round, rectangular, or square.

15. The gate of claim 1, wherein a cross section of the transmit loop is open, and is at least one of flat: U-shaped, or T-shaped.

* * * * *